US010300718B2

(12) United States Patent
Yamamoto et al.

(10) Patent No.: US 10,300,718 B2
(45) Date of Patent: May 28, 2019

(54) PRINTER AND PRINTING METHOD

(71) Applicant: Roland DG Corporation, Hamamatsu-shi, Kita-ku (JP)

(72) Inventors: Shinya Yamamoto, Hamamatsu (JP); Tetsuhiro Kunifuji, Hamamatsu (JP); Toshikazu Sugita, Hamamatsu (JP); Yudai Chida, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/832,845

(22) Filed: Dec. 6, 2017

(65) Prior Publication Data

US 2018/0154660 A1 Jun. 7, 2018

(30) Foreign Application Priority Data

Dec. 7, 2016 (JP) ..... 2016-237430

(51) Int. Cl.
*B41J 11/00* (2006.01)
*B41J 13/00* (2006.01)

(52) U.S. Cl.
CPC ..... *B41J 13/0009* (2013.01); *B41J 11/002* (2013.01)

(58) Field of Classification Search
CPC ..... B41J 11/002; B41J 13/0009
See application file for complete search history.

(56) References Cited

U.S. PATENT DOCUMENTS 5,581,289 A * 12/1996 Firl ..... B41J 11/002 271/9.09
9,403,358 B1 * 8/2016 Ferrara, Jr. ..... B41J 11/0015
2013/0215203 A1 * 8/2013 Chen ..... B41J 11/002 347/102
2014/0028768 A1 * 1/2014 Chen ..... B41J 11/002 347/102
2015/0022601 A1 * 1/2015 Ohnishi ..... B41J 11/002 347/102

FOREIGN PATENT DOCUMENTS

JP 2014-104604 A 6/2014

* cited by examiner

*Primary Examiner* — John Zimmermann
(74) *Attorney, Agent, or Firm* — Keating & Bennett, LLP

(57) ABSTRACT

A printer includes a media feeder to feeding media in a feed direction, a print head to eject droplets of ink onto the media, heaters to heat the media, and a controller to perform a printing operation corresponding to received print data by causing the media feeder to feed the media heated by the heaters and causing the print head to eject the droplets of ink onto the media based on the print data, the controller being configured or programmed to move the media and/or the heaters during the print idle time before performing the printing operation.

8 Claims, 7 Drawing Sheets

| TYPE | OUTWARD SPEED | INWARD SPEED |
|---|---|---|
| MEDIA A | 10mm/s | 5mm/s |
| MEDIA B | 5mm/s | 2.5mm/s |

FIG. 7

| TYPE | OUTWARD FEED AMOUNT | INWARD FEED AMOUNT |
|---|---|---|
| MEDIA A | 10mm per feed | 5mm per feed |
| MEDIA B | 5mm per feed | 2.5mm per feed |

(ONE FEED PER SECOND)

FIG. 8

PRINTER AND PRINTING METHOD

CROSS REFERENCE TO RELATED APPLICATIONS

This application claims the benefit of priority to Japanese Patent Application No. 2016-237430 filed on Dec. 7, 2016. The entire contents of this application are hereby incorporated herein by reference.

BACKGROUND OF THE INVENTION

1. Field of the Invention

The present invention relates to printers and printing methods.

2. Description of the Related Art

Inkjet printers are known as examples of printers. Some inkjet printers heat media using a heater to increase the temperature of the media during printing or dry the media after printing. For example, JP-A-2014-104604 describes an inkjet printer provided with a heater.

To build a heater for heating media, a heating thread (e.g., a resistance wire such as a nichrome wire) may be arranged with a sinuous form. With the heater having such a configuration, portions of the heating thread are arranged at a distance from each other in a feed direction. If media is kept heated on the heater during a print idle time, areas on these portions of the heating thread become warmer than the remaining areas between them. The consequent non-uniform heating of the media results in a problem of wrinkling of the media (so-called cockling).

SUMMARY OF THE INVENTION

Preferred embodiments of the present invention reduce non-uniform heating of media during print idle time and reduce cockling of the media.

Preferred embodiments of the present invention provide printing apparatuses that are able to reduce non-uniform heating of media during the print idle time and reduce cockling of the media.

A printing apparatus according to a preferred embodiment of the present invention includes a media feeder, a print head, heaters, and a controller. The media feeder feeds the media in a feed direction. The print head ejects droplets of ink onto the media. The heaters heat the media. The controller performs a printing operation corresponding to a received print data by causing the media feeder to feed the media heated by the heaters and causing the print head to eject the droplets of ink onto the media based on the print data, the controller being configured or programmed to move the media and/or the heaters during the print idle time before performing the printing operation.

Other features of preferred embodiments of the present invention will be described in the present specification.

According to preferred embodiments of the present invention, it is possible to reduce non-uniform heating of media during the print idle time and reduce cockling of the media.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 7 is a diagram for describing media-feed speed during the print-ready operation.

FIG. 8 is a diagram for describing another print-ready operation.

DETAILED DESCRIPTION OF THE PREFERRED EMBODIMENTS

From the description in the present specification, at least following preferred embodiments will be disclosed.

A printer includes a media feeder to feed media in a feed direction, a print head to eject droplets of ink onto the media, heaters to heat the media, and a controller to perform a printing operation corresponding to a received print data by causing the media feeder to feed the media heated by the heaters and causing the print head to eject the droplets of ink onto the media based on the print data, the controller being configured or programmed to move the media and/or the heaters during the print idle time before performing the printing operation will be shown. The printer of this kind reduces non-uniform heating of media during the print idle time and reduces cockling of the media.

It is desirable that the media and/or the heaters are moved by causing the media feeder to feed the media during the print idle time. This makes it possible to simplify structures of printers.

It is desirable that the media feeder moves the media forward and backward during the print idle time. This makes it possible to control the length of media ejected during the print idle time.

It is desirable that at least one of a media-feed amount and a media-feed speed is different between forward movement and backward movement when the media feeder moves the media forward and backward during the print idle time. This makes it possible to move up the starting time of printing.

It is desirable that the media-feed speed during the print idle time is different depending on a type of the media. This makes it possible to heat the media to an appropriate temperature.

It is desirable that the higher a heat capacity of the media is, the more the media-feed speed during the print idle time is reduced. This makes it possible to heat the media to an appropriate temperature.

It is desirable that portions of the media located on or above the heaters are positioned between the heaters by moving the media and/or the heaters. This makes it possible to reduce non-uniform heating of media during the print idle time.

A method of printing uses a media feeder to feed media in a feed direction, a print head to eject droplets of ink onto the media, and heaters to heat the media, the heaters and the media being arranged at a distance from each other in the feed direction, the method including performing a printing operation corresponding to a received print data by causing the media feeder to feed the media heated by the heaters and causing the print head to eject the droplets of ink onto the media based on the print data, and moving the media and/or the heaters during the print idle time before performing the printing operation will be shown. The printing method of this kind makes it possible to reduce non-uniform heating of media during the print idle time and reduce cockling of the media.

First Preferred Embodiment

Figure 1:
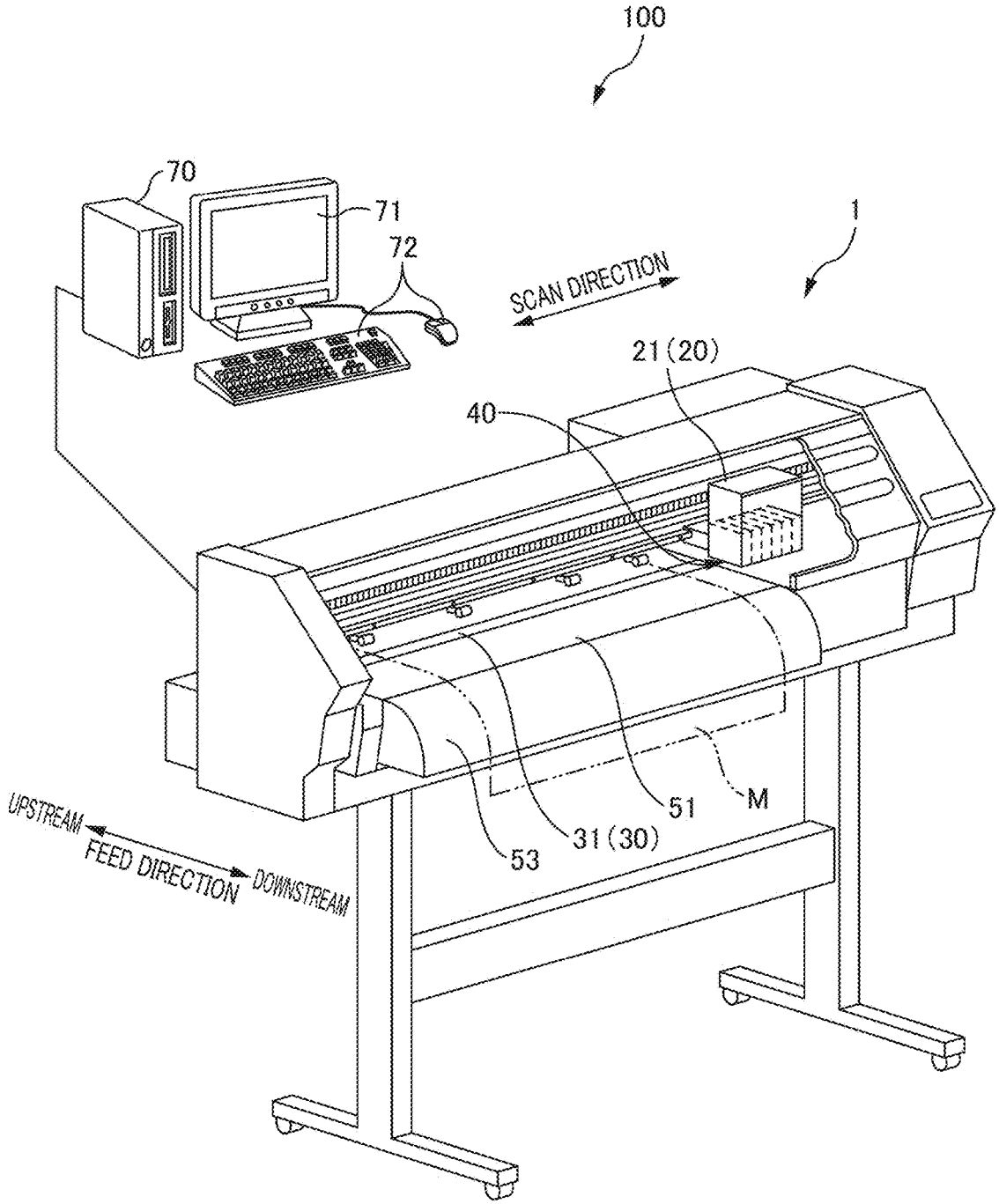
FIG. 1 is a schematic diagram of a printing system 100 according to a preferred embodiment of the present invention.
Figure 2:
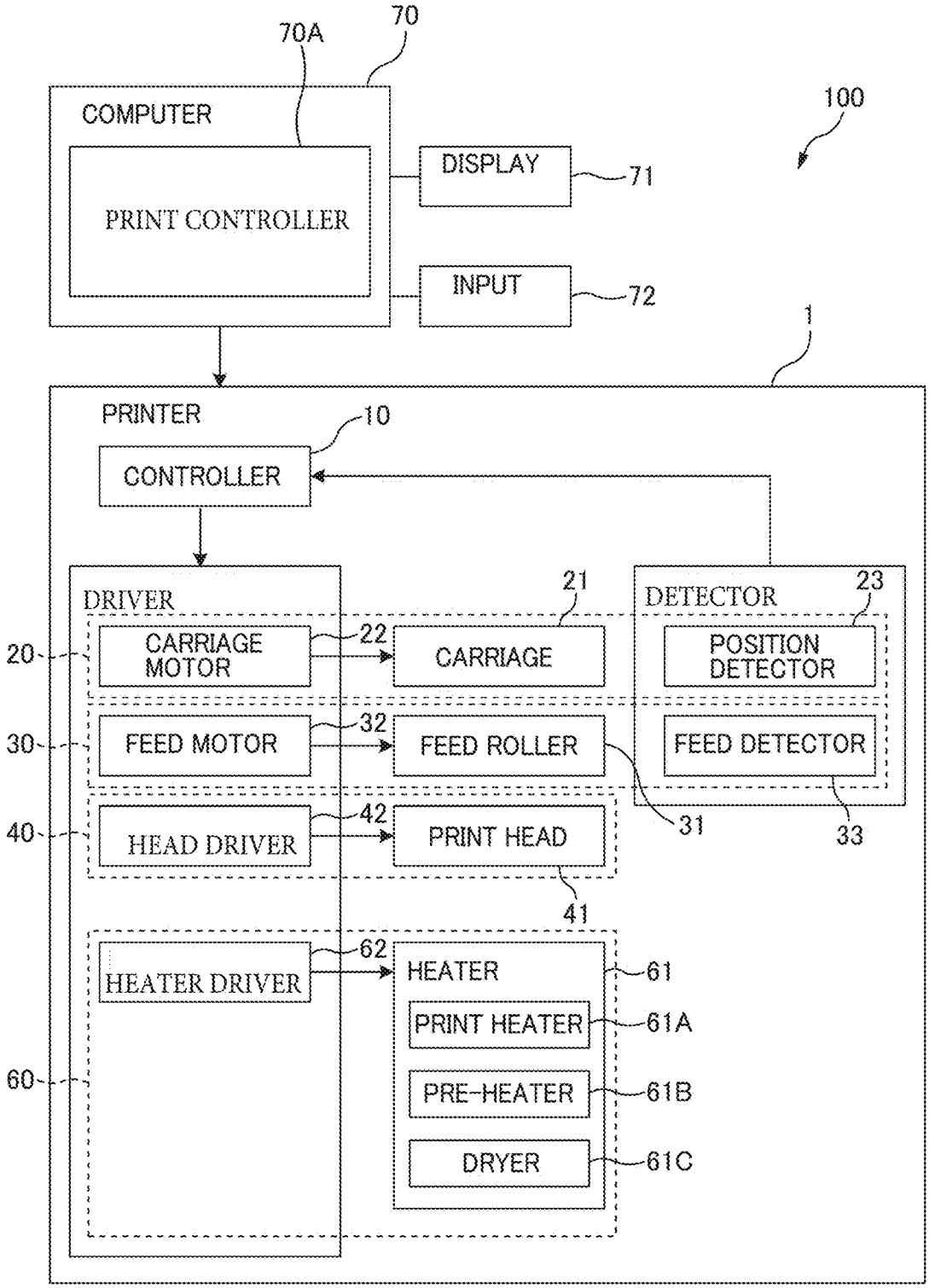
FIG. 2 is a block diagram of the printing system 100.

FIG. 1 is a schematic diagram of a printing system 100 according to a first preferred embodiment of the present invention, and FIG. 2 is a block diagram of the printing system 100.

In the following description, the direction in which a carriage 21 moves is sometimes referred to as a "scan direction" or a "right-and-left direction." The direction in which media M is fed during printing is sometimes referred to as a "feed direction." A media-feed area where the media M enters and an exit area where the media M leaves are sometimes referred to as "upstream (upstream side)" and "downstream (downstream side)" respectively.

The printing system 100 is used to perform printing by ejecting ink droplets onto the media M. The printing system 100 includes a printer 1 and a computer 70. It should be noted that the printing system 100 may be achieved using the printer 1 alone by implementing the function of the computer 70 in the printer 1.

The printer 1 is a device that performs printing by ejecting ink droplets onto the media M. Specifically, the printer 1 is an inkjet printer. The printer 1 of this preferred embodiment includes a controller 10, a carriage unit 20, a media feeder 30, a printing unit 40, and heaters 60.

The controller 10 is a controller that controls the printer 1. The controller 10 controls drivers (such as a carriage motor 22, a feed motor 32, and a head driver 42) of the printer 1 based on print data (print command codes) received from the computer 70.

The carriage unit 20 reciprocates the carriage 21 in the scan direction (right-and-left direction). The carriage unit 20 includes the carriage 21 and the carriage motor 22. The carriage is a member that reciprocates in the scan direction. The carriage 21 carries a print head 41 and thus the print head 41 can be reciprocated in the scan direction by the reciprocation of the carriage 21 in the scan direction. The carriage motor 22 is a driver that moves the carriage 21 in the scan direction. The controller 10 controls the movement of the carriage 21 by controlling the driving of the carriage motor 22. The carriage unit 20 includes a position detector 23 to detect the position of the carriage 21 (or the print head 41) in the scan direction. The position detector 23 may directly detect the position of the carriage 21 in the scan direction or indirectly detect it by detecting an amount of drive (amount of rotation) of the carriage motor 22. The position detector 23 provides feedback of the detection result to the controller 10.

The media feeder 30 feeds the media M of a continuous sheet type such as rolled paper, for example. The media M is not limited to paper and may be film or fabric media. The media feeder 30 includes a feed roller 31 and the feed motor 32. The feed roller 31 is a rotation roller that feeds the media M. The media M can be fed in the feed direction by rolling the feed roller 31 while the media M being held between the feed roller 31 and a pinch roller. The feed motor 32 rotates the feed roller 31. The controller 10 controls the feed of the media M by controlling the driving of the feed motor 32. The media feeder 30 includes a feed detector 33 to detect an amount of feeding of the media M. The feed detector 33 may directly detect the amount of movement of the media M (media-feed amount) or indirectly detect it by detecting an amount of rolling movement of the feed roller 31 or an amount of driving (rotation amount) of the feed motor 32. The feed detector 33 provides feedback of the detection result to the controller 10. It should be noted that, in this preferred embodiment, the media feeder 30 can feed the media M from the upstream side to the downstream side along the feed direction by rolling the feed roller 31 in the forward direction and feed (reverse-feed) the media M from the downstream side to the upstream side along the feed direction by rolling the feed roller 31 in reverse (reverse rolling) to the forward direction.

The printing unit 40 ejects ink droplets onto the media M. The printing unit 40 includes the print head 41 and the head driver 42. The print head 41 is an inkjet print head with a number of nozzles to eject droplets of ink. The head driver 42 causes the nozzles of the print head 41 to start and stop ejecting ink droplets. The head driver 42 is, for example, a driver that drives a piezo element when the print head 41 is a piezoelectric print head. The print head 41 is mounted on the carriage 21 and reciprocates along with the carriage 21 in the scan direction. The controller 10 controls the ejecting of ink droplets from the print head 41 by controlling the head driver 42.

In this preferred embodiment, the print head 41 ejects droplets of solvent ink. When printing is performed on the media M using solvent ink, it is desirable that the media M is heated in order to raise the temperature of the media M during printing or to dry the media M after printing. Accordingly, the printer 1 of this preferred embodiment includes the heaters 60.

The heaters 60 heat the media M. The heaters 60 include a heater 61 and a heater driver 62. The heater 61 generates heat to heat the media M. The heater driver 62 controls conduction of electricity to the heater 61.

Figure 3A:
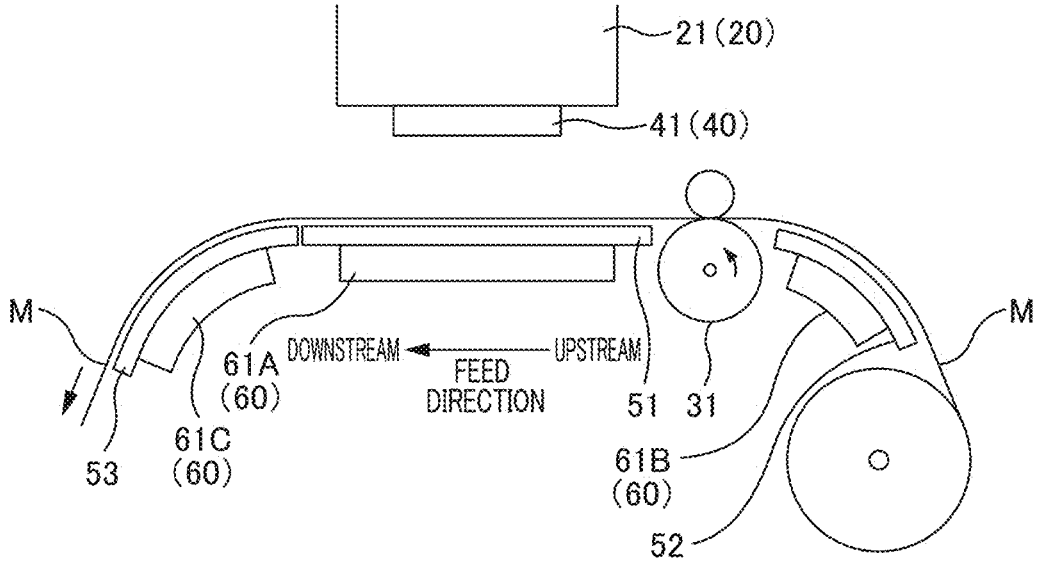
FIG. 3A is a diagram for describing an arrangement of a heater 61.

The heater 61 includes a print heater 61A, a pre-heater 61B, and a dryer 61C. FIG. 3A is a diagram for describing an arrangement of the heater 61.

The print heater 61A heats the media M in an area (print area) in which droplets of ink are ejected from the print head 41. A platen 51 (media support) to support the media M is provided in the print area opposite to the print head 41 (see, FIGS. 1 and 3A). The print heater 61A is positioned to heat the media M through the platen 51. The print heater 61A may be built in the platen 51 or disposed on the back side of the platen 51.

The pre-heater 61B heats the media M in an area upstream side of the print area. The pre-heater 61B heats the media M before being fed to the print area. By using the pre-heater 61B, the print heater 61A can be set at a relatively low temperature. As shown in FIG. 3A, an upstream support 52 to support the media M is provided at an upstream side of the platen 51. The pre-heater 61B is provided so that it can heat the media M through the upstream support 52. The pre-heater 61B may be built in the upstream support 52 or disposed on the back side of the upstream support 52. The heaters 60 may not have the pre-heater 61B.

The dryer 61C is a dryer that heats the media M in an area downstream side of the print area. The dryer 61C may be referred to as a post-heater. The dryer 61C heats and dries the media M after printing. A downstream support 53 (apron) to support the media M is provided at a downstream side of the platen 51. The dryer 61C is provided so that it can heat the media M through the downstream support 53. The dryer 61C may be built in the downstream support 53 or disposed on the back side of the downstream support 53. The heaters 60 may not have the dryer 61C.

Figure 3B:
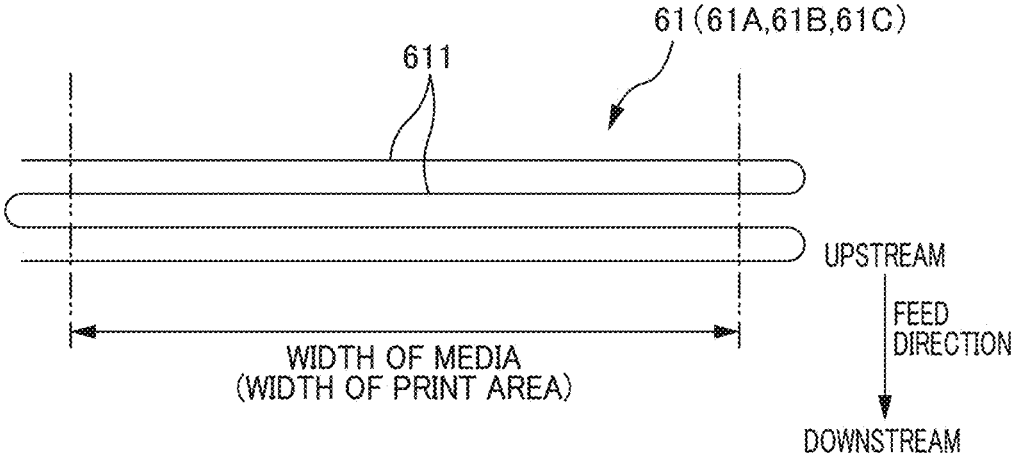
FIG. 3B is a diagram for describing a configuration of the heater 61.

FIG. 3B is a diagram for describing a configuration of the heater 61. In this preferred embodiment, each of the print heater 61A, the pre-heater 61B and the dryer 61C is achieved using a heating thread 611 (e.g., a resistance wire such as a nichrome wire) in a sinuous form as shown in FIG. 3B. The heating thread 611 extends along the scan direction beyond the width (the dimension in the scan direction) of the print area (or the media M), and is bent at points outside the print area into the sinuous form. With the heating thread 611 arranged in the sinuous form, portions of the heating thread 611 parallel or substantially parallel to the scan direction are arranged to line up at a distance from each other to the feed direction in the print area.

It should be noted that not all of the print heater 61A, the pre-heater 61B, and the dryer 61C have the configuration shown in FIG. 3B. The heating thread 611 may have a different shape (such as a thickness) or may be arranged at a different distance depending on the type of the heater 61.

The computer 70 is a print control device configured or programmed to control the printer 1. The computer 70 generates print data (print command codes) to control the printer 1 and transmits the print data to the printer 1. The printer 1 that has received the print data from the computer 70 controls each component according to the print data and performs a printing operation corresponding to the print data. The computer 70 is, for example, a general-purpose personal computer 70, and a CPU of the computer 70 functions as a print controller 70A which generates the print data by executing a print control program. The computer 70 may be connected to a display 71 or an input 72 such as a keyboard, for example.

Figure 4:
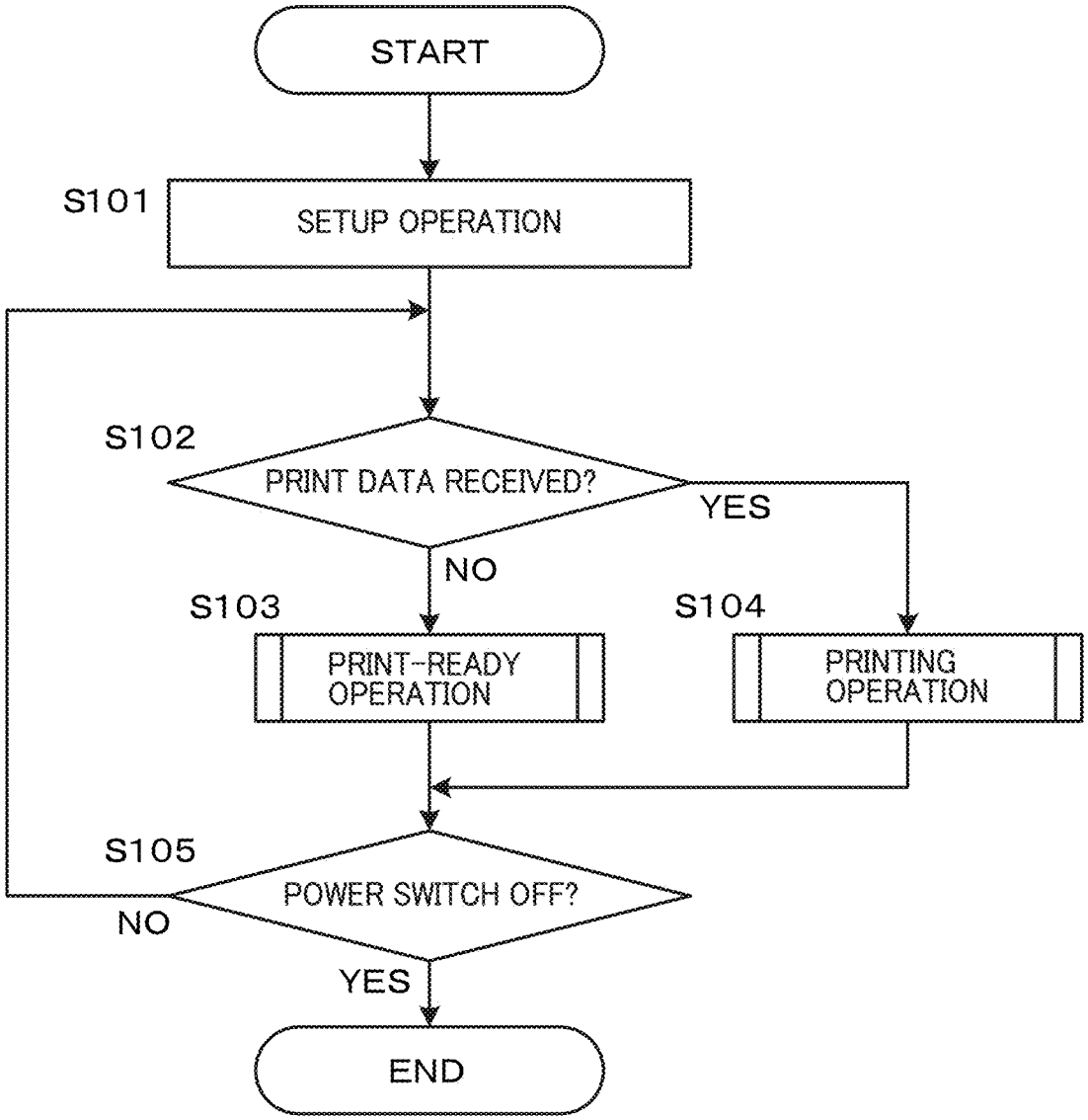
FIG. 4 is a flowchart showing an operation of a printer 1.

FIG. 4 is a flowchart showing an operation of the printer 1. A procedure shown in the figure is started when a power switch (not shown) of the printer 1 is turned on.

First, the controller 10 performs a predetermined setup operation (S101). The setup operation includes an operation of cleaning the print head 41, a feeding operation to feed the media M to a predetermined print start position, and a heating operation of warming of the heater 61.

Next, the controller 10 performs a print-ready operation (S103) while no print data is received (NO at S102). The print-ready operation at S103 is described later. When receiving print data (YES at S102), the controller 10 performs a printing operation corresponding to the print data (S104). In the process performed at S104, the controller 10 performs the printing operation corresponding to the print data based on the print data by alternately repeating the feeding of the media M by the media feeder 30 while heating the media M by the heaters 60 and ejecting droplets of ink onto the media M from the print head 41.

The controller 10 repeats the processes at S102 to 104 before the power switch is turned off (NO at S105). When the power switch is turned off (YES at S105), the controller 10 terminates the procedure.

As described above, the controller 10 performs the print-ready operation (S103) before performing the printing operation (before receiving the print data). If the heaters 60 are kept unheated during the print-ready operation and the heaters 60 are caused to generate heat at the beginning of the printing operation (when the print data is received), it takes time to heat the media M to a desired temperature. This delays the start of the printing operation, increasing the total time required for printing (the time from the reception of the print data to the completion of the printing). It is thus desirable that the media M is kept warm by the heaters 60 during the print-ready operation (S103) before the printing operation. By heating the media M by the heaters 60 during the print idle time at S103, the media M is already warmed at the beginning of the printing operation at S104. As a result, the printing operation is able to be started promptly and the print time is able to be reduced.

If, however, the media M is kept heated on the heater 61 having the configuration shown in FIG. 3B during the print idle time, areas on the heating portions of the heating thread 611 become warmer than the remaining areas between them due to the continuous heating (see, FIG. 6A; described below). Consequently, non-uniform heating of the media M results in a problem of wrinkling of the media M (so-called cockling).

Accordingly, in this preferred embodiment, the controller 10 moves the media M and/or the heating thread 611 during the print idle time. As a result, the media M is heated uniformly and cockling is reduced. This is described below.

Figure 5:
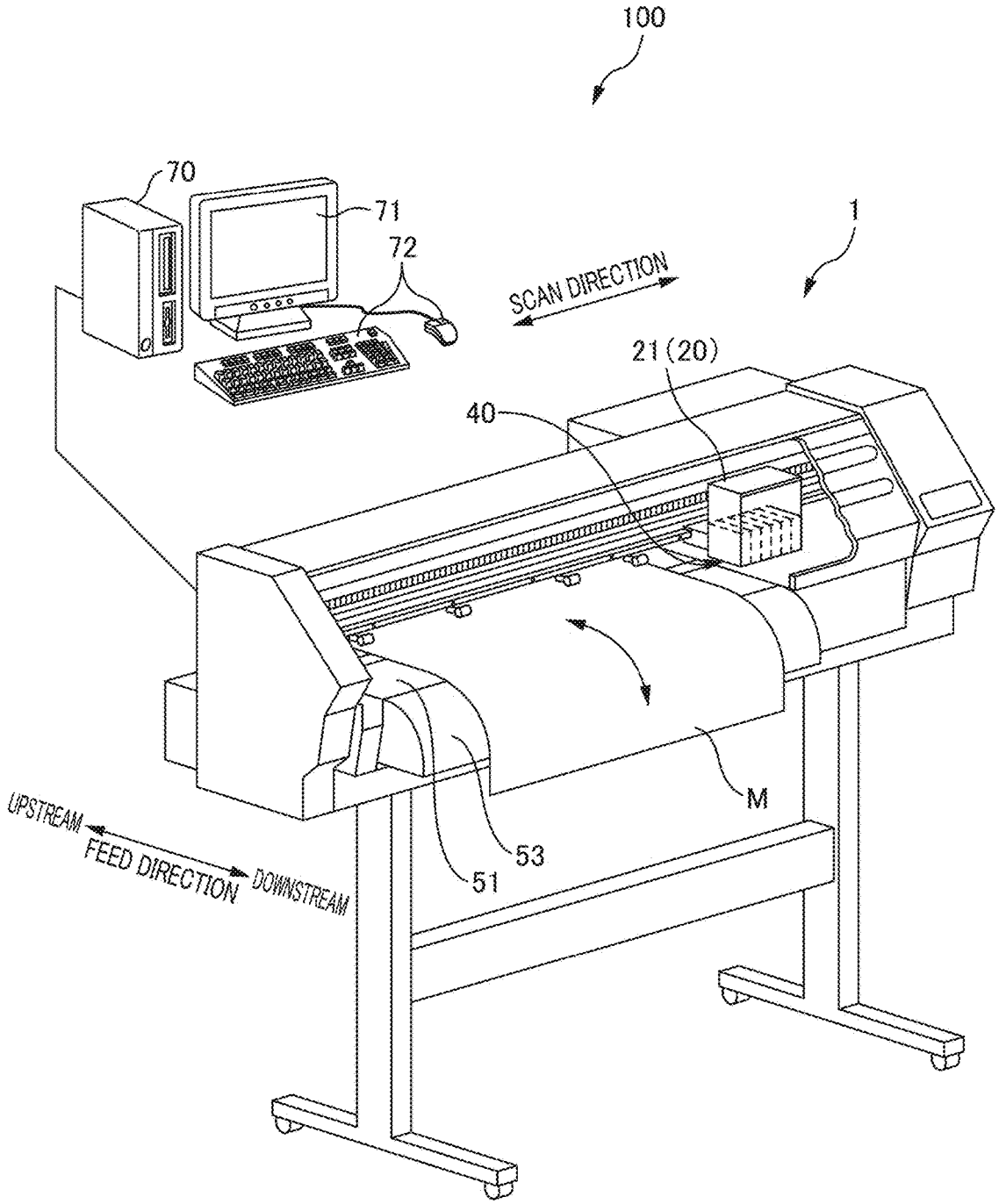
FIG. 5 is a diagram for describing how a print-ready (make-ready for printing) operation proceeds.

FIG. 5 is a diagram for describing how the print-ready operation proceeds.

In this preferred embodiment, the controller 10 causes the media feeder 30 to feed the media M during the print-ready operation in order to move the media M relative to the heating thread 611. It should be noted that the heating thread 611 may be moved relative to the media M during the print-ready operation by moving the heating thread 611 in the feed direction rather than causing the media feeder 30 to feed the media M. In this case, however, a mechanism to move the heating thread 611 in the feed direction is required. This complicates the structure of the printer 1 and increases costs associated with the printer 1. On the other hand, as is shown in this preferred embodiment, it is possible to make good use of the media feeder 30 and reduce the costs associated with the printer 1 when the relative movement between the media M and the heating thread 611 is achieved by feeding the media M while using the media feeder 30.

Furthermore, in this preferred embodiment, as shown in FIG. 5, the controller 10 controls the media feeder 30 so that it moves the media M forward and backward during the print-ready operation. If the media M is fed only in one direction during the print-ready operation, the media M of a continuous sheet type is ejected out of the printer 1 during the print-ready operation when continued for a long period of time. On the other hand, as is shown in this preferred embodiment, the length of the media M ejected during the print-ready operation is able to be controlled by causing the media feeder 30 to move the media M forward and backward during the print-ready operation. For example, since the feeding of the media M by about 25 cm to the downstream side in the feed direction and the feeding (reverse-feeding) of the media M by the same length in the reverse direction are repeated during the print-ready operation in this preferred embodiment, the length of the media M ejected at the downstream side of the print area during the print-ready operation is about 25 cm at maximum.

Figure 6A:
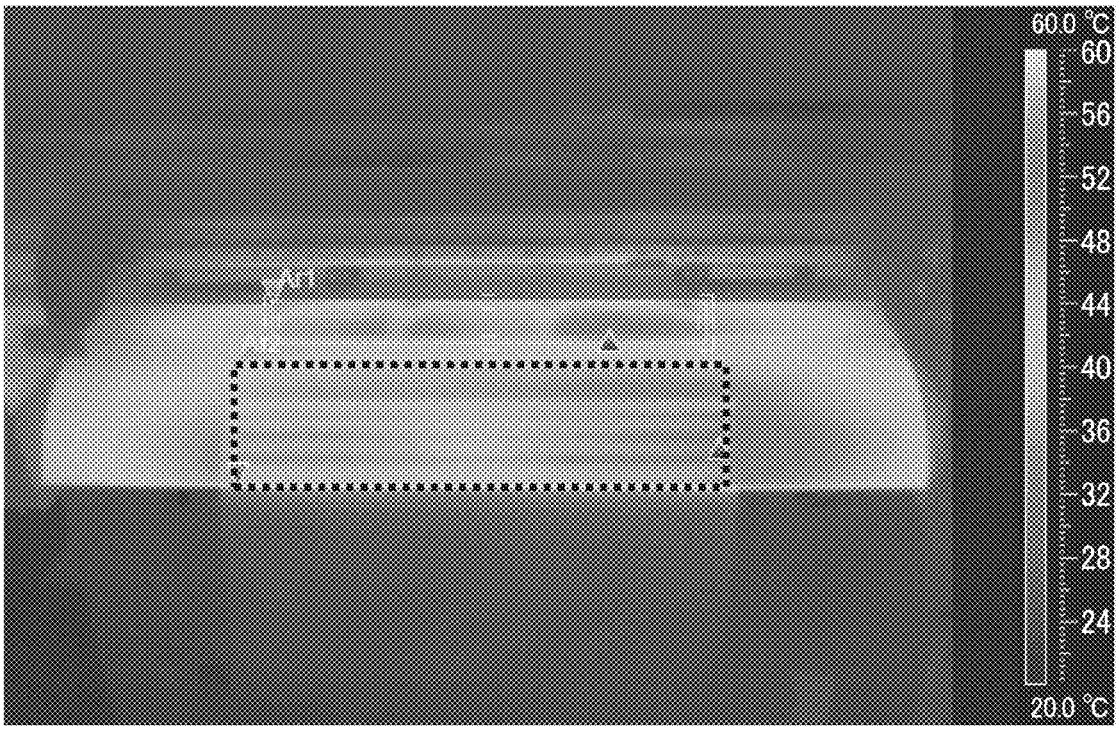
FIG. 6A is an image for describing a temperature distribution of a media M in a comparative example.
Figure 6B:
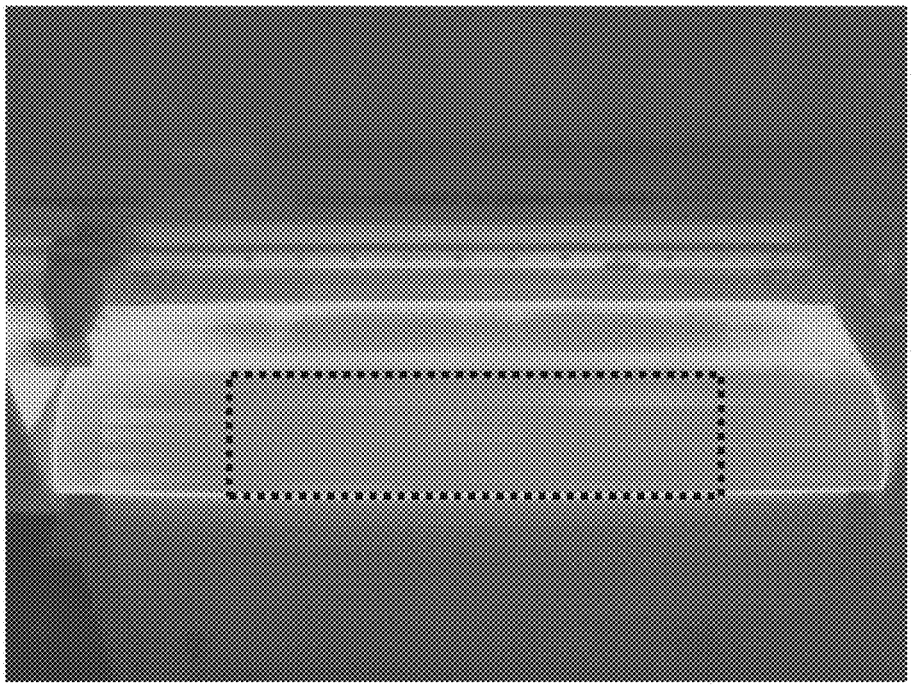
FIG. 6B is an image for describing a temperature distribution of the media M in a preferred embodiment of the present invention.

FIG. 6A is an image for describing a temperature distribution of the media M in a comparative example. FIG. 6B is an image for describing a temperature distribution of the media M in this preferred embodiment. Both show the temperature distribution of the media M during the print idle time obtained by thermography. In the images, the area of the heater 61 (the dryer 61C herein) is circumscribed by a dotted line. In the comparative example, the media M is not fed during the print-ready operation and the relative positional relationship between the media M and the heating thread 611 is fixed. In the comparative example, as shown in FIG. 6A, hot regions appear like stripes in the temperature distribution of the media M. These hot regions correspond to the regions on the heating thread 611. It can be understood that the media M in the comparative example is non-uniformly heated as shown in FIG. 6A. On the other hand, it can be understood that the media M in this preferred embodiment is heated uniformly as shown in FIG. 6B.

FIG. 7 is a diagram for describing media-feed speed during the print-ready operation. A memory (not shown) of the printer 1 stores tables (see, FIG. 7) in which types of the media M and media-feed speeds are correlated. The controller 10 determines the media-feed speed during the print-ready operation based on the type of the media M loaded in the printer 1.

This preferred embodiment applies different media-feed speeds between the feeding of the media M in an outward direction (a direction toward the downstream side along the feed direction) and the feeding (reverse-feeding) of the media M in an inward direction (a direction toward the upstream side along the feed direction). In particular, in this preferred embodiment, the media-feed speed is lower in cases where the media M is fed in the inward direction than in cases where the media M is fed in the outward direction. The reason for this lies in the purpose of moving up the time to start printing by heating the media M more during the inward feeding of the media (when the media M already ejected to the downstream side during the print-ready operation is pulled back) because it takes a shorter period of time to align the edge of the media M with an original point at the beginning of the printing operation in the inward feeding of the media M than in the outward feeding of it. Depending on other conditions, however, the media-feed speed may be lower in cases where the media M is caused to be fed in the outward direction than in cases where the media M is caused to be fed in the inward direction. The media-feed speed may be constant regardless of the orientation of the feed direction of the media M.

Furthermore, in this preferred embodiment, the media-feed speed for the media M during the print idle time is varied depending on the type of the media M. This is because the media M under heating exhibits different change in temperature depending on the type of the media M. By varying the media-feed speed for the media M during the print idle time depending on the type of the media M as is shown in this preferred embodiment, the media M is able to be heated to an appropriate temperature before the start of the printing operation. It should be noted that the amount of heat generated by the heaters 60 may be varied rather than varying the media-feed speed, depending on the type of the media M.

In this preferred embodiment, a "media B" has a higher heat capacity than a "media A" in FIG. 7. For example, the "media B" is thicker than the "media A" and has a higher heat capacity than the "media A." For media having high heat capacity such as the "media B," adding the same amount of heat to the media produces less increase in the temperature (i.e., the media heats slower). Accordingly, in this preferred embodiment, the higher a heat capacity of the media is, the more the media-feed speed during the print idle time is reduced. This makes it possible to heat the media to an appropriate temperature before the start of the printing operation.

FIG. 8 is a diagram for describing another feeding movement during the print-ready operation. The controller 10 causes the media M to be fed by a predetermined amount of feed once a second during the print-ready operation. The amount of feed per movement differs between the feeding of the media M in an outward direction (a direction toward the downstream side along the feed direction) and the feeding (reverse-feeding) of the media M in an inward direction (a direction toward the upstream side along the feed direction). In this way, the amount of feed per movement rather than the media-feed speed may be varied between the outward and inward feeding. In this case, the amount of feed may be varied depending on the type of the media M.

When the media M is fed by a predetermined amount of feed during the print-ready operation (see, FIG. 8), it is desirable that the portions of the media M located on the heating thread 611 before feeding are located where not on the heating thread 611 after the feeding of the media M. To achieve such feeding, the amount of feed per movement is shorter than the distance between the adjacent portions of the heating thread 611. This makes it possible to prevent hot regions of the media M (which are located on the heating thread 611) before feeding from heating again after the feeding and to heat the media M uniformly during the print idle time.

Other Preferred Embodiments

The foregoing preferred embodiments have been provided as examples and are not intended to limit the scope of the present invention. The above configurations can be implemented in appropriate combinations, and various omissions, replacements, and changes can be made without departing from the scope of the present invention. The above preferred embodiments and modifications thereof are included in the scope and spirit of the present invention as well as within the inventions described in the claims and their equivalents.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printer comprising:

a media feeder to feed media in a feed direction;

a print head to eject droplets of ink onto the media;

heaters to heat the media; and a controller configured or programmed to perform a printing operation corresponding to a received print data by causing the media feeder to feed the media heated by the heaters and causing the print head to eject the droplets of ink onto the media based on the print data, the controller being configured or programmed to move the media and/or the heaters during a print idle time before performing the printing operation, wherein the media feeder moves the media forward and backward repeatedly during the print idle time and while the heaters are heating the media.

2. The printer according to claim 1, wherein the heaters include heating threads arranged at a distance from each other in the feed direction.

3. The printer according to claim 1, wherein the media and/or the heaters are moved by causing the media feeder to feed the media during the print idle time.

4. The printer according to claim 3, wherein at least one of a media-feed amount and a media-feed speed is different between forward movement and backward movement when the media feeder moves the media forward and backward during the print idle time.

5. The printer according to claim 3, wherein the media-feed speed during the idle time is different depending on a type of the media.

6. The printer according to claim 5, wherein the higher a heat capacity of the media is, the more the media-feed speed during the print idle time is reduced.

7. The printer according to claim 1, wherein portions of the media located on or above the heaters are positioned between the heaters by moving the media and/or the heaters.

8. A method of printing using a media feeder to feed media in a feed direction, a print head to eject droplets of ink onto the media, and heaters to heat the media, the method comprising:

performing a printing operation corresponding to received print data by causing the media feeder to feed the media heated by the heaters and causing the print head to eject the droplets of ink onto the media based on the print data; and moving the media and/or the heaters during a print idle time before performing the printing operation, wherein the media feeder moves the media forward and backward repeatedly during the print idle time and while the heaters are heating the media.

* * * * *